US011382435B2

(12) United States Patent
Maurer

(10) Patent No.: US 11,382,435 B2
(45) Date of Patent: Jul. 12, 2022

(54) BED COVER RETENTION APPARATUS

(71) Applicant: Scott D. Maurer, Asheville, NC (US)

(72) Inventor: Scott D. Maurer, Asheville, NC (US)

( * ) Notice: Subject to any disclaimer, the term of this patent is extended or adjusted under 35 U.S.C. 154(b) by 46 days.

(21) Appl. No.: 16/990,700

(22) Filed: Aug. 11, 2020

(65) Prior Publication Data

US 2022/0047089 A1 Feb. 17, 2022

(51) Int. Cl.
*A47C 21/02* (2006.01)

(52) U.S. Cl.
CPC ..... *A47C 21/022* (2013.01)

(58) Field of Classification Search
CPC ..... A47C 21/022; Y10T 24/23
See application file for complete search history.

(56) References Cited

U.S. PATENT DOCUMENTS 2,223,412 A * 12/1940 Gartz ..... A47C 21/022 24/72.5
2,321,394 A * 6/1943 King ..... A47C 21/022 24/72.5
2,459,497 A * 1/1949 Calabro ..... A47C 21/022 24/72.5
4,662,016 A * 5/1987 Seeman ..... A47C 21/022 24/72.5
4,782,543 A * 11/1988 Hutton ..... A47C 21/022 24/72.5
5,467,491 A 11/1995 Griffith
6,295,670 B1 10/2001 Schieberl
6,457,194 B1 10/2002 Bennett
6,907,628 B2 6/2005 El Guermaai
7,152,260 B2 12/2006 Ota
7,467,428 B2 12/2008 Hanes
7,698,759 B1 4/2010 Frasier
8,745,787 B1 6/2014 Heimlich
9,055,830 B2 * 6/2015 Tzur ..... A47G 9/04
9,591,929 B1 3/2017 Surman
10,617,219 B2 * 4/2020 Lowe ..... A47C 21/022
2017/0202361 A1 * 7/2017 White ..... F16B 2/10

* cited by examiner

*Primary Examiner* — Robert Sandy
*Assistant Examiner* — Louis A Mercado
(74) *Attorney, Agent, or Firm* — William G. Heedy; The Van Winkle Law Firm

(57) ABSTRACT

A bed cover retention apparatus (10) has a planar strip (12), an elastic band (14), and a clip (16). The planar strip has a high friction first surface (12B), a second surface (12A), an inserted end (26), and a distal end (28). The elastic band is interposed between, and connected to, the inserted end of the planar strip and the clip. The high friction first surface is preferably a lower surface, and the second surface is preferably, but not necessarily, a smooth upper surface. An optional extraction hole (20) and/or an optional extraction ridge (22) may be provided.

15 Claims, 6 Drawing Sheets

BED COVER RETENTION APPARATUS

BACKGROUND

A smooth-looking bed cover gives an impression of neatness and attention to detail. To achieve that look, the bottom sheet that covers the mattress is often a fitted sheet, meaning that it has elastic at the corners, and sometimes along the top and bottom edges and sides. When the bottom sheet is taut, the upper sheet and any additional bed covers, such as blankets and spreads, will have a smooth, unwrinkled appearance. If, however, the bottom sheet is loose it can bunch or wrinkle, and this can result in the topmost bed cover, such as a spread, having sags and wrinkles and a less than desirable appearance.

Moreover, a smooth-looking bed cover is typically desirable from the perspective of a user in terms of comfort. A bunched or wrinkled bottom sheet can be uncomfortable for a user to lay upon.

In addition, bottom sheets are made to fit various sized mattresses according to their top surface dimensions such as twin, double, queen and king. However, even though these sheets fit the top surface dimensions, the depth of mattresses varies substantially and the manufactured pockets composing the vertical sides of these "fitted" sheets must be tall enough to accommodate the maximum mattress depth or the fitted sheets will quickly rise up on the mattress and become loose fitting. Further, if the pocket is made for a thick mattress but is actually used on a less thick mattress then the fitted sheet will initially have a loose fitting. Also, the fitted sheets may become loose as they stretch during use. The result is a loose, wrinkly and wavy bottom sheet which can result in the topmost bed cover having sags and wrinkles, therefore resulting in a less than desirable appearance and feel for the user. Thus, frequent manual re-stretching and re-tucking of the fitted sheet is required in order to maintain the desired appearance.

Various devices have been proposed to assist in maintaining that tightly-fitted look. Elastic straps, installed on the underside of the mattress, attempt to maintain both initial tension on the sheet and continued tension as the sheet moves and stretches. These elastic strap systems, however, require tedious lifting and displacement of the mattress to install and reconnect the elastic straps. Rigid clips are less difficult to use than the above-mentioned elastic straps but they do not maintain tension on the sheet as it moves and stretches. There are also belt type elastic bands that encircle the vertical perimeter of the mattress. These are also difficult to install, have an unsightly appearance, and fail to maintain a smooth surface as the sheet moves and stretches.

SUMMARY

An improved bed cover retention apparatus is described. The bed cover retention apparatus has a planar strip, an elastic band, and a clip. The planar strip has a high friction first surface, an opposing second surface, an inserted end, and a distal end. The elastic band is interposed between, and connected to, the inserted end of the planar strip and the clip. The first surface may be a lower surface, and the second surface may be a smooth upper surface.

DETAILED DESCRIPTION

Figure 1:
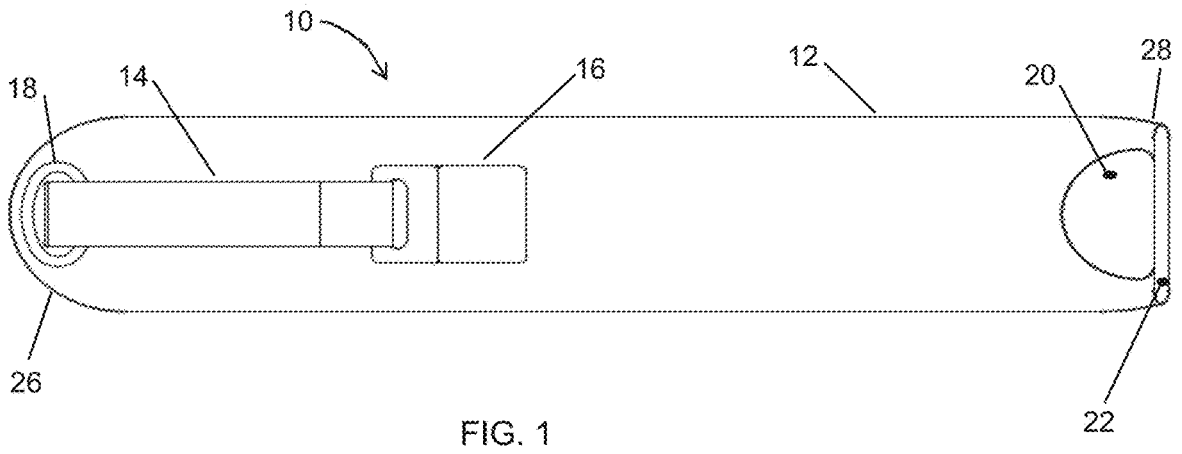
FIG. 1 is a top view of a bed cover retention apparatus.
Figure 2:
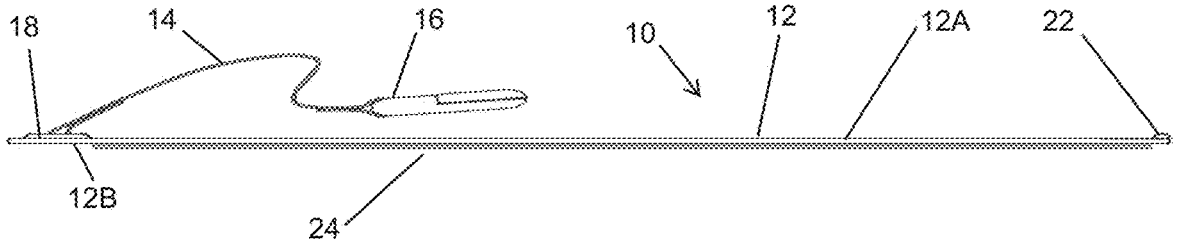
FIG. 2 is a side view of the bed cover retention apparatus.
Figure 3:
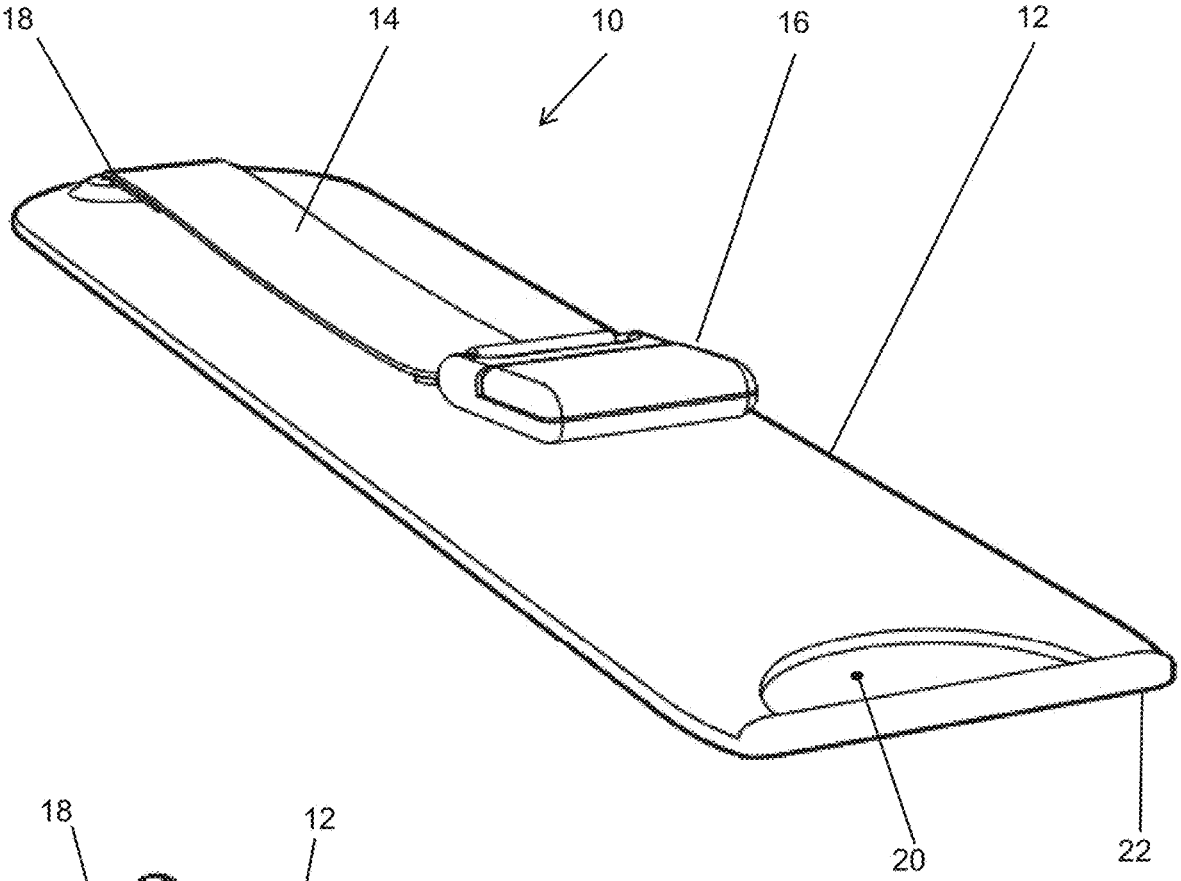
FIG. 3 is a top perspective view of the bed cover retention apparatus.
Figure 4:
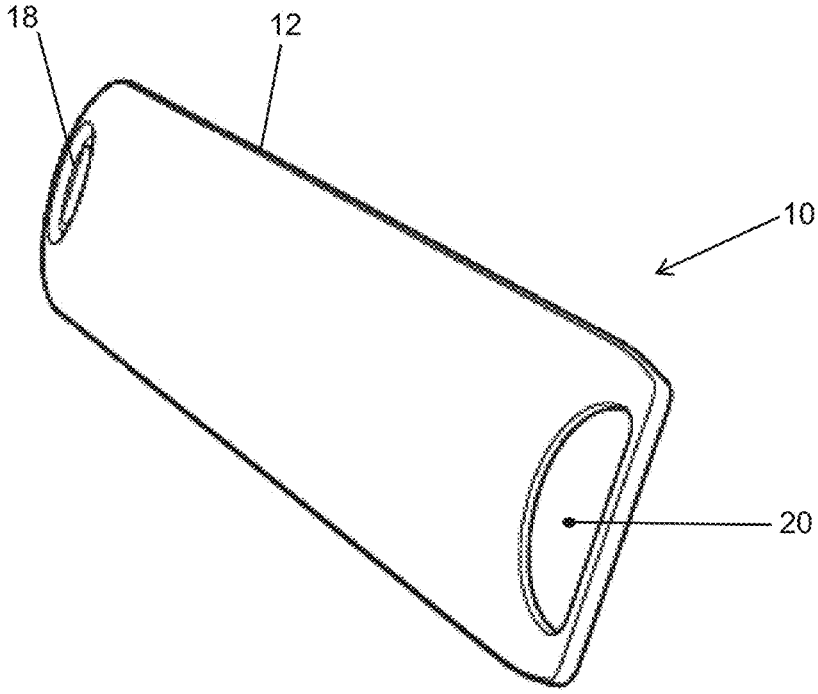
FIG. 4 is a bottom perspective view of the bed cover retention apparatus.

FIGS. 1, 2, 3, and 4 are top, side, top perspective, and bottom perspective views, respectively, of a bed cover retention apparatus 10, showing a planar strip 12, elastic band 14, a clip 16, a band retention hole 18, a layer of a flexible material 24, an optional retraction hole 20, and an optional retraction lip or ridge 22.

Figure 5A:
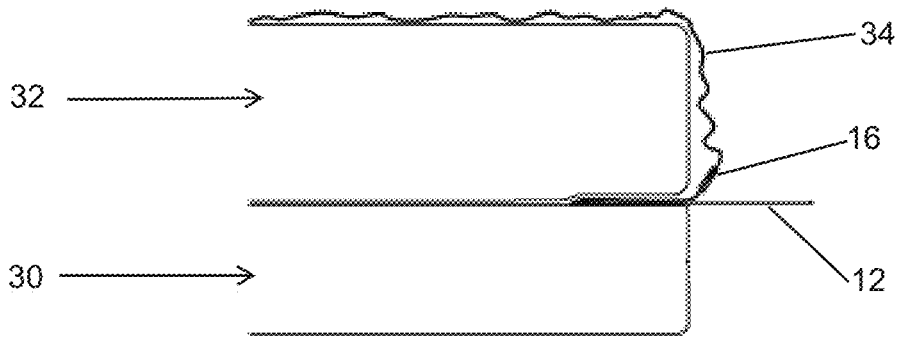
FIGS. 5A to 5C are an illustration of the installation of the bed cover retention apparatus.
Figure 5B:
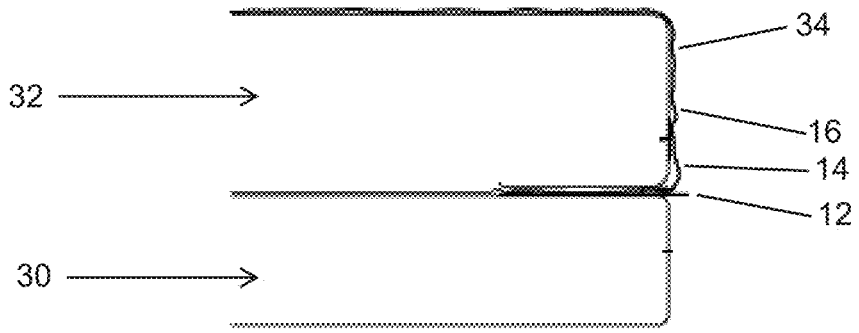
Figure 5C:
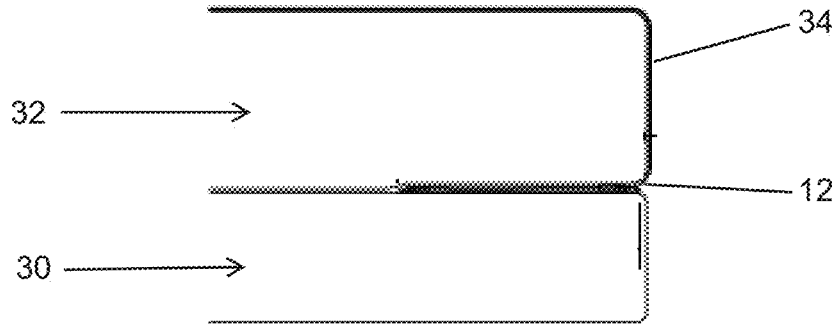

FIGS. 5A to 5C are an illustration of the installation of the bed cover retention apparatus 10. The insertion end 26 of the planar strip 12 is inserted between the upper mattress 32 and the wooden base or box spring or lower mattress 30 (referred to hereinafter as the "box spring" to avoid having to repeatedly list the box spring and the lower mattress in the alternative) and the clip 16 is attached to an edge of the sheet 34, which is preferably, but not necessarily, a fitted sheet. The planar strip 12 is then pushed further between the mattress 32 and box spring 30, which causes tension to be placed on the sheet 34. The planar strip 12 is then pushed further between, or completely between, the mattress 32 and box spring 30, so that, preferably, but not necessarily, little or none of the distal, extraction end 28 is showing, thereby maximizing the tension placed on the sheet 34 and causing the sheet 34 to have a taut, smooth-looking appearance and smooth feel.

Removal is accomplished by the reverse process, pulling the planar strip 12 at least partially from between the box spring 30 and the mattress 32, and unhooking the clip 16 from the sheet 34. If another sheet 34 is to be used, then the clip 16 is attached to the sheet 34 and the planar strip 12 is then pushed back between the box spring 30 and the mattress 32. If, however, another sheet 34 is not to be immediately used, such as if the mattress 32 is to be flipped or rotated, then the planar strip 12 is pulled completely out from between the box spring 30 and the mattress 32.

Figure 6:
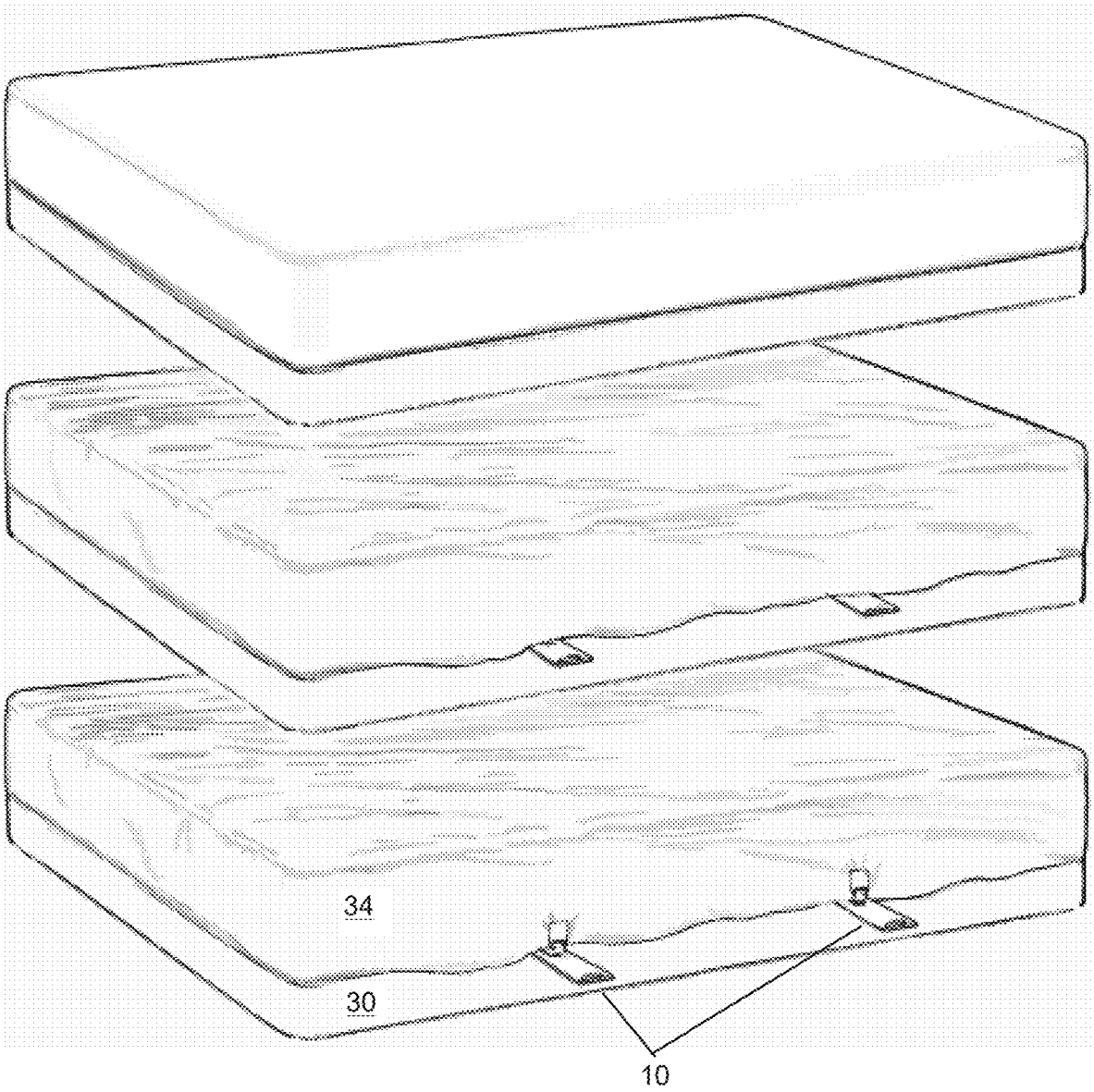
FIG. 6 is another illustration of the installation of the bed cover retention apparatus.

FIG. 6 is another illustration of the installation of the bed cover retention apparatus 10, corresponding, from the bottom up, to FIGS. 5A-5C, respectively.

Referring again to FIGS. 1-4, the planar strip 12 preferably has a surface 12B and an opposing surface 12A. The surface 12B may covered by a flexible material 24 which provides a high friction surface, or surface 12B itself may be a high friction surface, such as a rough surface, in which case the flexible material 24 might not be used. The high friction surface provides enough friction between the planar strip 12 and the box spring 30 to prevent the tension of the elastic band 14 from pulling the planar strip 12 out from its deeply-seated position between the mattress 32 and the box spring 30. This friction is not so great however that a user cannot pull the planar strip 12 out without damaging the cover of the box spring 30. An example of a suitable material for the flexible material 24 is Product No. ALQR001A made by Riken Elastomers Corp. Other materials may also be used. In an embodiment the flexible material 24 has a rectangular pattern thereon. Other patterns may also be used provided that they provide the desired degree of friction with respect to the box spring 30.

In an implementation, the planar strip 12 is a rigid planar strip. In another implementation, the planar strip 12 is rigid enough to allow it to be pushed between the box spring 30 and the mattress 32.

In an implementation, the upper surface 12A is a smooth surface. In another implementation, the upper surface 12A provides additional friction to help hold the bed cover retention apparatus 10 in place.

In an implementation, the planar strip 12 has a length of between approximately 12 inches and 24 inches. In an implementation, the planar strip 12 has a length of between approximately 15 inches and 20 inches.

In an implementation, the planar strip 12 has a uniform width of between approximately 2 inches and 4 inches. In an implementation, the planar strip 12 has a uniform width of between approximately 3 inches and 4 inches. In another implementation, the planar strip 12 may taper so that the inserted end is smaller than the distal end.

In an implementation, the planar strip 12 has an extraction hole 20, which provides the user with a convenient way to grasp and extract the planar strip 12 that has been inserted between the mattress 32 and the box spring 30. In another implementation, the planar strip 12 does not have an extraction hole.

In an implementation, the planar strip 12 has an extraction lip or ridge 22, which provides the user with a convenient way to grasp and extract the planar strip 12 that has been inserted between the mattress 32 and the box spring 30. In another implementation, the planar strip 12 does not have an extraction lip.

In an implementation, the inserted end of the planar strip 12 is rounded or curved. In another implementation, the inserted end of the planar strip 12 is substantially squared.

Figure 7:
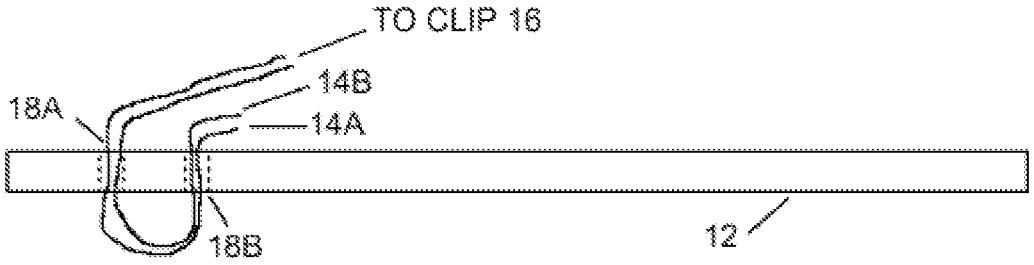
FIG. 7 is an illustration of an exemplary retaining hole to secure an elastic band.

In an implementation a plug fits into the retaining hole 18 and the elastic band 14 is secured to the plug. In another implementation, as seen in FIG. 7, the retaining hole 18 comprises first and second slots 18A, 18B, and the elastic band 14 is routed through the slots 18A, 18B. One end 14A of the elastic band 14 is routed through slot 18A and then through slot 18B, and the other end 14B of the elastic band 14 is also routed through slot 18A and then through slot 18B.

Figure 8:
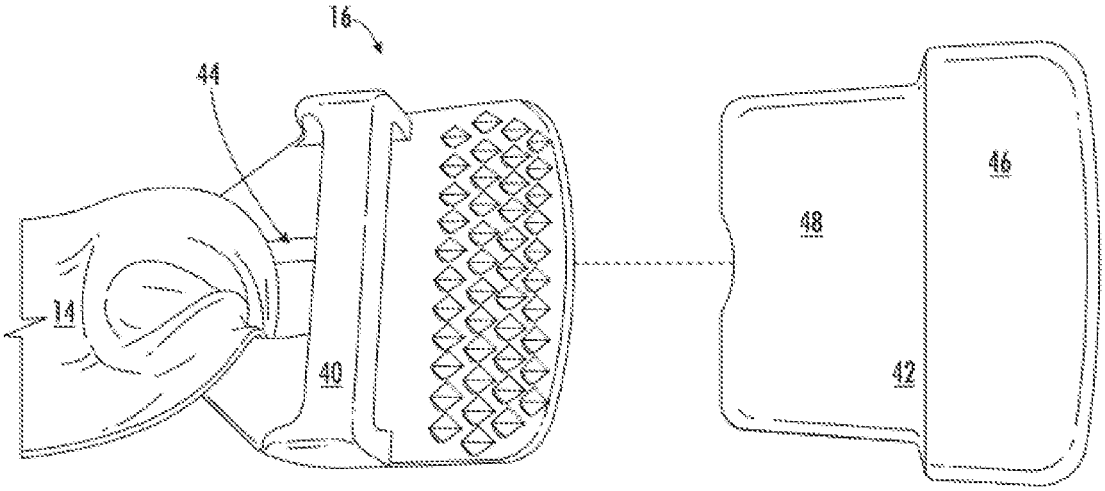
FIG. 8 is an illustration of an exemplary clip.

FIG. 8 is an illustration of an exemplary clip 16 to secure the elastic band 14. The clip 16 has a body portion 40 and an insert portion 42. The body portion 40 has a hole or aperture 44 through which the elastic band 14 is routed. The insert portion 42 has a head end 46 and a tapered end 48. In use, an edge of the sheet 34 is placed against the body portion 40 and the insert portion 42 is pushed into the body portion 40, thereby securing the sheet 34 to the clip 16. Alternatively, an edge of the sheet 34 may be routed around the tapered end 48, and then the insert portion 42 is pushed into the body portion 40, thereby securing the sheet 34 to the clip 16. For more details regarding the construction of the clip 16, please see U.S. Pat. No. 6,789,295 to Svensson, the disclosure and teachings of which are hereby incorporated herein by reference. Other types of clips may also be used but care should be taken that the clip selected does not damage the sheet 34.

Figure 9:
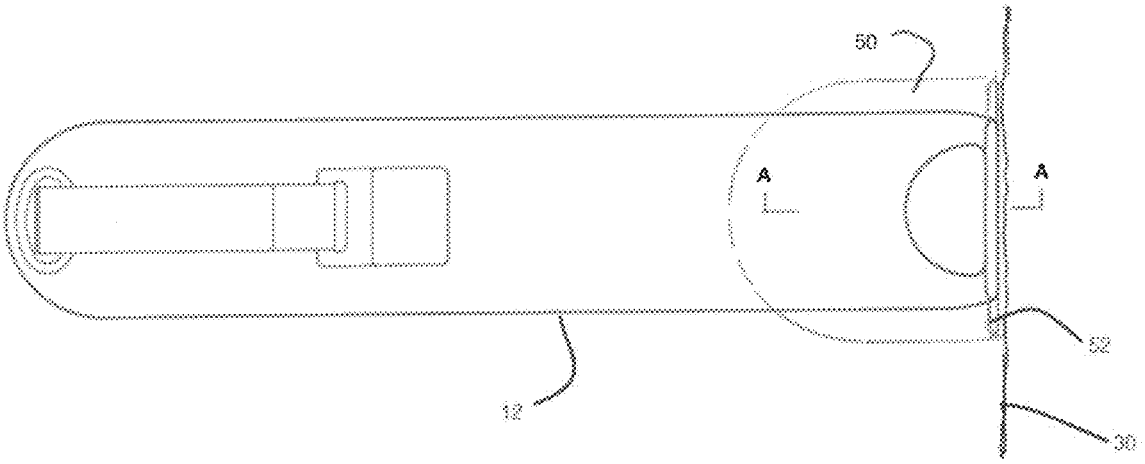
FIG. 9 is a top view of a bed cover retention apparatus.
Figure 10:
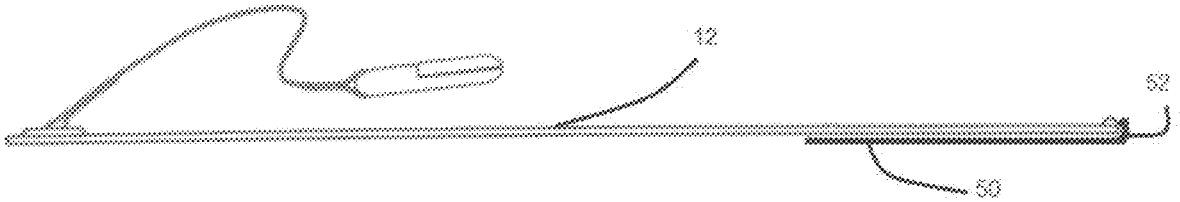
FIG. 10 is a side view of the bed cover retention apparatus of FIG. 9.
Figure 11:
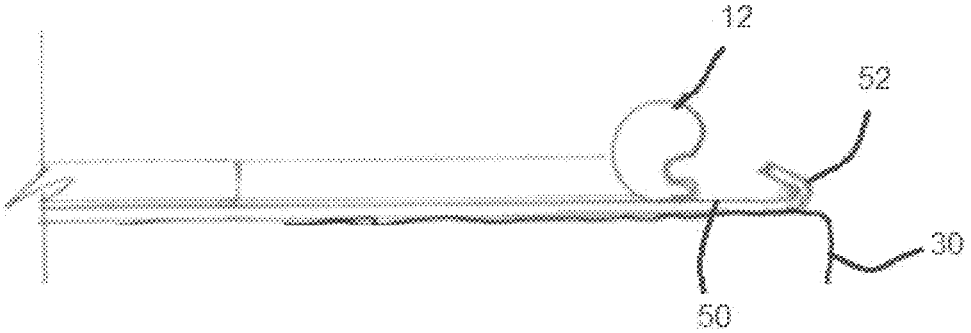
FIG. 11 is cross sectional view of the bed cover retention apparatus taken along line A-A in FIG. 9.

FIGS. 9-11 illustrate an embodiment of the bed cover retention apparatus 10 including a retainer 50 including a protrusion 52, such as a hook, that may be affixed to the box spring 50. The retainer 50 may be affixed to the box spring 30 in one or more ways, including, but not limited to, using an adhesive, screw or nail. In this implementation, the planar strip 12 is sized and configured to be selectively, releasably secured to the retainer 50 such that, when the sheet 34 is secured to the planar strip 12, tension is applied to the sheet 34, thereby causing the sheet 34 to have a taut, smooth-looking appearance and smooth feel. It is also considered that the retainer 50 may be affixed to the bottom surface of the mattress 32 to achieve the same objective.

The disclosed bed cover retention apparatus 10 may therefore be positioned to be out of sight, provides for ease of installation, provides for ease of removal, and maintains a constant tension on the sheet as it moves and stretches during use.

Also, it will be appreciated that when a person sits or lays upon the mattress 32, the weight of that person will cause tension to be exerted on the elastic band 16. That same weight, however, presses the mattress 32 and the box spring 30 more tightly against the planar strip, thereby increasing the frictional force which prevents the planar strip 12 from being pulled outwardly.

Unless otherwise defined, all terms (including technical and scientific terms) used herein have the same meaning as commonly understood by one of ordinary skill in the art to which this subject matter belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. For brevity and/or clarity, well-known functions or constructions may not be described in detail herein.

The terms "for example" and "such as" mean "by way of example and not of limitation." The subject matter described herein is provided by way of illustration for the purposes of teaching, suggesting, and describing, and not limiting or restricting. Combinations and alternatives to the illustrated embodiments are contemplated, described herein, and set forth in the claims.

For convenience of discussion herein, when there is more than one of a component, that component may be referred to herein either collectively or singularly by the singular reference numeral unless expressly stated otherwise or the context clearly indicates otherwise. For example, components N (plural) or component N (singular) may be used unless a specific component is intended. Also, the singular forms "a," "an," and "the" are intended to include the plural forms as well, unless expressly stated otherwise or the context indicates otherwise.

It will be further understood that the terms "includes," "comprises," "including," and/or "comprising" specify the presence of stated features, steps, operations, elements, and/or components, but do not preclude the presence or addition of one or more other features, steps, operations, elements, components, and/or groups thereof unless explicitly stated otherwise or the context clearly requires otherwise. The terms "includes," "has" or "having" or variations in form thereof are intended to be inclusive in a manner similar to the term "comprises" as that term is interpreted when employed as a transitional word in a claim.

It will be understood that when a component is referred to as being "connected" or "coupled" to another component, it can be directly connected or coupled or coupled by one or more intervening components unless expressly stated otherwise or the context clearly indicates otherwise.

The term "and/or" includes any and all combinations of one or more of the associated listed items. As used herein, phrases such as "between X and Y" and "between about X and Y" should be interpreted to include X and Y unless expressly stated otherwise or the context clearly indicates otherwise.

Terms such as "about", "approximately", and "substantially" are relative terms and indicate that, although two values may not be identical, their difference is such that the apparatus or method still provides the indicated or desired result, or that the operation of a device or method is not adversely affected to the point where it cannot perform its intended purpose. As an example, and not as a limitation, if a height of "approximately X inches" is recited, a lower or higher height is still "approximately X inches" if the desired function can still be performed or the desired result can still be achieved.

While the terms vertical, horizontal, upper, lower, bottom, top, and the like may be used herein, it is to be understood that these terms are used for ease in referencing the drawing and, unless otherwise indicated or required by context, does not denote a required orientation.

The different advantages and benefits disclosed and/or provided by the implementation(s) disclosed herein may be used individually or in combination with one, some or possibly even all of the other benefits. Furthermore, not every implementation, nor every component of an implementation, is necessarily required to obtain, or necessarily required to provide, one or more of the advantages and benefits of the implementation.

Conditional language, such as, among others, "can", "could", "might", or "may", unless specifically stated otherwise, or otherwise understood within the context as used, is generally intended to convey that certain embodiments preferably or optionally include certain features, elements and/or steps, while some other embodiments optionally do not include those certain features, elements and/or steps. Thus, such conditional language indicates, in general, that those features, elements and/or step may not be required for every implementation or embodiment.

The subject matter described herein is provided by way of illustration only and should not be construed as limiting the nature and scope of the subject invention. While examples of aspects of the subject invention have been provided above, it is not possible to describe every conceivable combination of components or methodologies for implementing the subject invention, and one of ordinary skill in the art may recognize that further combinations and permutations of the subject invention are possible. Furthermore, the subject invention is not necessarily limited to implementations that solve any or all disadvantages which may have been noted in any part of this disclosure. Various modifications and changes may be made to the subject invention described herein without following, or departing from the spirit and scope of, the exemplary embodiments and applications illustrated and described herein. Although the subject matter presented herein has been described in language specific to components used therein, it is to be understood that the subject invention is not necessarily limited to the specific components or characteristics thereof described herein; rather, the specific components and characteristics thereof are disclosed as example forms of implementing the subject invention. Accordingly, the disclosed subject matter is intended to embrace all alterations, modifications, and variations, that fall within the scope and spirit of any claims that are written, or may be written, for the subject invention.

The foregoing detailed description is intended only to convey to a person having ordinary skill in the art the fundamental aspects of the invention and is not intended to limit, and should not be construed as limiting, the scope of the invention.

The invention claimed is:

1. A bed cover retention apparatus comprising:

a planar strip having a body, a covering forming a high friction first surface, an opposing second surface, an inserted end, and a distal end, the covering comprising a layer of a flexible material;

a clip; and an elastic band interposed between, and connected to, the inserted end of the planar strip and the clip.

2. The bed cover retention apparatus of claim 1, wherein the distal end of the planar strip has an extraction hole.

3. The bed cover retention apparatus of claim 1, wherein the opposing second surface is smooth.

4. The bed cover retention apparatus of claim 1, wherein the planar strip has a uniform width.

5. The bed cover retention apparatus of claim 1, wherein the high friction first surface is a uniform surface.

6. The bed cover retention apparatus of claim 1, wherein the inserted end is rounded.

7. The bed cover retention apparatus of claim 1, wherein:

the inserted end of the planar strip has first and second slots therein; and the elastic band is routed through the first and second slots to secure the elastic band to the planar strip.

8. The bed cover retention apparatus of claim 7, wherein:

the elastic band has a first end and a second end; and both the first end and the second end are routed through both the first and second slots to secure the elastic band to the planar strip.

9. The bed cover retention apparatus of claim 1, wherein the high friction first surface is a lower surface.

10. The bed cover retention apparatus of claim 1, wherein the opposing second surface is a smooth surface.

11. A bed cover retention apparatus comprising:

a planar strip having a body, a covering, a smooth upper surface, an inserted end, and a distal end, the covering forming a high friction lower surface;

a clip; and an elastic band interposed between, and connected to, the inserted end of the planar strip and the clip.

12. The bed cover retention apparatus of claim 11, wherein the covering comprises a layer of a flexible material.

13. The bed cover retention apparatus of claim 11, wherein the distal end of the planar strip has an extraction hole.

14. The bed cover retention apparatus of claim 11, wherein the distal end of the planar strip has an extraction ridge.

15. A bed cover retention apparatus comprising:

a planar strip having a high friction lower surface, a smooth upper surface, an inserted end, and a distal end, the inserted end having first and second slots therein, the distal end having an extraction hole and an extraction ridge;

a clip having an aperture; and an elastic band having a first end and a second end, the first end and the second end being routed through both the first and second slots to secure the elastic band to the planar strip, the elastic band passing through the aperture of the clip.

* * * * *